US009546846B2

(12) United States Patent
Stewart

(10) Patent No.: US 9,546,846 B2
(45) Date of Patent: Jan. 17, 2017

(54) VIDEO CAMERA GUN BARREL MOUNTING SYSTEM

(71) Applicant: David A. Stewart, Boca Raton, FL (US)

(72) Inventor: David A. Stewart, Boca Raton, FL (US)

( * ) Notice: Subject to any disclaimer, the term of this patent is extended or adjusted under 35 U.S.C. 154(b) by 0 days.

(21) Appl. No.: 15/049,862

(22) Filed: Feb. 22, 2016

(65) Prior Publication Data

US 2016/0169629 A1 Jun. 16, 2016

Related U.S. Application Data

(60) Division of application No. 13/733,229, filed on Jan. 3, 2013, now Pat. No. 9,267,761, which is a continuation of application No. 13/420,844, filed on Mar. 15, 2012, now Pat. No. 8,908,045.

(60) Provisional application No. 61/582,545, filed on Jan. 3, 2012, provisional application No. 61/453,014, filed on Mar. 15, 2011.

(51) Int. Cl.

| | |
|---|---|
| ***G03B 17/00*** | (2006.01) |
| ***F41G 11/00*** | (2006.01) |
| ***F41G 3/26*** | (2006.01) |
| ***F41G 1/54*** | (2006.01) |
| ***F41G 3/00*** | (2006.01) |
| *F41G 1/35* | (2006.01) |
| *F41J 5/10* | (2006.01) |

(52) U.S. Cl.

CPC ..... *F41G 11/002* (2013.01); *F41G 1/54* (2013.01); *F41G 3/00* (2013.01); *F41G 3/005* (2013.01); *F41G 3/26* (2013.01); *F41G 3/2605* (2013.01); *F41G 11/004* (2013.01); *F41G 1/35* (2013.01); *F41J 5/10* (2013.01)

(58) Field of Classification Search

USPC ..... 396/419, 426

See application file for complete search history.

(56) References Cited

U.S. PATENT DOCUMENTS

| | | | | |
|---|---|---|---|---|
| 2,769,895 | A * | 11/1956 | Boord | F41G 1/35 211/26 |
| 3,374,544 | A * | 3/1968 | Pitchford | F41G 11/001 42/126 |
| 4,824,374 | A | 4/1989 | Hendry | F41G 3/2611 434/21 |
| 5,026,158 | A | 6/1991 | Golubic | F41G 1/38 356/252 |

(Continued)

*Primary Examiner* — Rodney Fuller

(74) *Attorney, Agent, or Firm* — Fleit Gibbons Gutman Bongini Bianco PL; Jon Gibbons

(57) ABSTRACT

A shock absorbing mount on a gun using a camera system for training a shooter. The mount includes a mounting bracket with an upper portion having an opening defined therein for firmly mechanically attaching to at least one barrel of a gun and a lower portion for firm mechanically attaching to a tube assembly. The tube assembly is adapted to slidably mount carriage assembly of a camera therein. The tube assembly includes a first end with a first captive cap holding a lens window directed toward a gun front sight when mounted on the gun, the first end including a load transfer ring positioned between the first captive cap and a carriage assembly body of the camera. A programming system is also disclosed to translate a relative position of the generated reticule overlay relative to a generated graticule overlay using the offset previously stored.

10 Claims, 7 Drawing Sheets

(56) References Cited

U.S. PATENT DOCUMENTS 5,118,186 A 6/1992 Schratzenstaller ..... F41G 3/326 356/153
5,845,165 A 12/1998 McMahan ..... 396/426
5,991,043 A 11/1999 Andersson ..... F41G 3/2611 356/400
6,070,355 A 6/2000 Day ..... 42/106
6,385,894 B1 5/2002 Podvin ..... 42/146
6,425,697 B1 * 7/2002 Potts ..... F41A 33/00 352/243
6,792,206 B2 9/2004 Gordon ..... 396/263
7,117,624 B2 10/2006 Kim ..... F41G 11/003 362/110
7,162,806 B1 1/2007 Swiggart ..... 33/265
7,559,169 B2 7/2009 Hung et al. ..... 42/119
7,780,363 B1 8/2010 Holmberg ..... 396/426
8,069,605 B2 12/2011 Fressola et al. ..... 42/90
8,093,992 B2 1/2012 Jancic et al. ..... 340/12.5
8,613,619 B1 12/2013 Couet ..... F41A 33/00 434/11
8,769,858 B2 7/2014 Hancosky ..... F41G 1/54 42/113
8,908,045 B2 12/2014 Stewart ..... H04N 5/225 348/169
2002/0027190 A1 3/2002 Hellak ..... F41J 5/02 250/222.1
2002/0197584 A1 12/2002 Kendir ..... F41G 3/2655 434/21
2004/0031184 A1 2/2004 Hope ..... 42/111
2004/0198336 A1 10/2004 Jancic et al. ..... 455/420
2005/0213962 A1 9/2005 Gordon ..... 396/502
2006/0082730 A1 4/2006 Franks ..... 352/95
2006/0201046 A1 9/2006 Gordon ..... 42/119
2007/0044365 A1 * 3/2007 Deken ..... F41C 27/00 42/146
2007/0051235 A1 3/2007 Hawkes et al. ..... 89/37.04
2007/0137087 A1 * 6/2007 Florea ..... F41G 11/004 42/90
2007/0147828 A1 6/2007 Nelson ..... 396/426
2007/0209268 A1 9/2007 Birurakis et al. ..... 42/119
2008/0060248 A1 3/2008 Pine et al. ..... 42/114
2008/0107414 A1 5/2008 Showalter ..... 396/429
2008/0112698 A1 5/2008 Ray ..... 396/56
2008/0233543 A1 9/2008 Guissin ..... F41A 33/00 434/19
2009/0252486 A1 10/2009 Ross et al. ..... 396/419
2010/0313461 A1 12/2010 Holmberg ..... 42/90
2011/0053120 A1 3/2011 Galanis ..... F41J 5/10 434/21
2012/0081913 A1 * 4/2012 Dew ..... F41G 11/004 362/396
2012/0126002 A1 5/2012 Rudich ..... 235/404
2012/0167437 A1 7/2012 Holmberg ..... 42/90
2012/0167441 A1 * 7/2012 Holmberg ..... F41G 11/004 42/119
2012/0180367 A1 7/2012 Singh ..... 42/117
2012/0258432 A1 10/2012 Weissler ..... F41J 5/24 434/20
2012/0270186 A1 10/2012 Singh ..... 434/19
2013/0111798 A2 5/2013 Russell ..... 42/90
2014/0059911 A1 3/2014 Oh et al. ..... 42/16

* cited by examiner

VIDEO CAMERA GUN BARREL MOUNTING SYSTEM

CROSS-REFERENCE TO RELATED APPLICATIONS

This application is based upon and claims priority to U.S. patent application Ser. No. 13/733,229 filed Jan. 3, 2013, entitled "VIDEO CAMERA GUN BARREL MOUNTING AND PROGRAMMING SYSTEM CAMERA DEVICE TO CAPTURE AND GENERATE TARGET LEAD AND SHOOTING TECHNIQUE DATA AND IMAGES", which is based upon and claims priority to U.S. patent application Ser. No. 13/420,844 filed Mar. 15, 2012, entitled "CAMERA DEVICE TO CAPTURE AND GENERATE TARGET LEAD AND SHOOTING TECHNIQUE DATA AND IMAGES", and U.S. Provisional Patent Application Ser. No. 61/582,545 filed Jan. 3, 2012, entitled "GUN CAMERA MOUNTING AND PROGRAMMING SYSTEMS", and U.S. Provisional Patent Application Ser. No. 61/453,014 filed Mar. 15, 2011, entitled "CAMERA DEVICE TO CAPTURE AND GENERATE TARGET LEAD AND SHOOTING TECHNIQUE DATA AND IMAGES", the disclosures of each are hereby incorporated by reference in their entirety.

FIELD OF THE INVENTION

This invention relates to the mounting and programming of a camera for the capturing of the images of a target, and/or the shooter, at the time around the discharge of a gun, bow, or shooting device. More particularly, the present invention relates to the process of mounting a digital video camera onto a gun barrel or shooting device and the programming of the video camera for the shooting environment associated with being mounted on a gun barrel or shooting device.

SUMMARY OF THE INVENTION

This invention will allow a camera to survive repeated vibration and shock from the gun discharges and allow the user to program the camera for their specific shooting device characteristics.

This invention has specific application in the hunting, target shooting, and law enforcement fields. The primary example used in the figures and description will be the case in which a shotgun is being used to shoot at clay targets at a suitable target range facility.

A video camera, or similar recording device, will use the mounting system described herein to be attached to a gun barrel or shooting device. In the case of a bow an option is to have a stabilizer that can allow the mounting system to be used in a similar manner to mounting on the barrel of a gun. The mounting system absorbs much of the shock and vibration of the gun discharge. The shock and vibration of gun discharges is further reduced and mitigated by the load transfer system which protects the active electrical components and the optical components of the video camera.

The video camera may have a sensor that detects the discharge of the gun and the video prior to discharge, during discharge, and post discharge will be recorded for display. The invented programming utility will manage the options of displaying still images, slow motion, and live video, around the discharge time combined with the options to display a reticule showing the approximate aim point of the gun.

The programming utility will allow the user to have the option of selecting a reticule which is representative of the shooting device being used. In the case of a shotgun on clay targets the reticule can be selected which best represents the choke of the barrel, the approximate distance to target, the shot pattern, and other factors which are determined by the cartridge and gun characteristics combined with the environmental influences.

The programming utility will allow the user to have the option of selecting trigger levels for video capture and recording, trigger levels and timing of sleep mode, camera settings, and video timing and playback speed for trigger event recordings.

The programming utility will allow the user to have the option of aligning the shooting device point of aim with the reticle point of aim and may use a calibration process involving an alignment correction calculated from a calibration process to reduce errors in point of aim alignment.

Accordingly, the present invention is directed, in part, to a system and method for the mounting and programming of a video camera to capture images of a shooting scenario, comprising:

(a) a video camera gun barrel mounting system.
(b) a translucent sealing membrane allowing ON/OFF switch activation and observation of status LED's.
(c) novel mounting techniques, shock absorbing methods, and geometries used in the mounting hardware, pads, the load ring, and the camera external assembly.
(d) a video camera programming system for matching the video camera settings to the shooting scenario.
(e) a calibration process to align the reticle point of aim with the shooting device point of aim.

DETAILED DESCRIPTION OF ILLUSTRATIVE EMBODIMENTS

Figure 8:
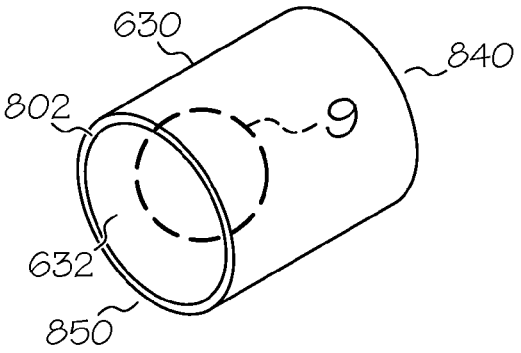
FIG. 4 through FIG. 9 is a pictorial representation of the present mounting system invention shock and vibration reduction system utilizing multiple layers and locations of shock absorbing material. It also shows the novel mounting techniques and geometries used in the pads, the load ring, and the camera external assembly groove for orientation control.
Figure 9:
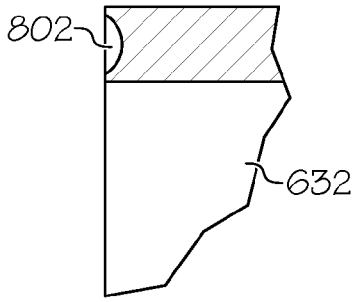

The present invention is generally directed to the process for the capture of video, slow motion, still images, and target lead data. More particularly, the present invention relates to the mounting hardware for a camera to be mounted on a gun barrel and the programming of the camera settings to match the characteristics of the gun in a shooting scenario, and to allow for the optional alignment of the camera point of aim with the shooting device point of aim.

Some advantages of the methods of the present invention include, in certain embodiments, the ability to have a camera attached to a gun barrel and absorb the shock and vibration of gun discharges; and the ability to have the camera be correctly aligned to the gun barrel and gun sights; and the ability to sustain the environmental challenges, including exposure to water, of shooting environments; and the ability to program the camera to match the shooting device, to the shooters performance, and the gun and target characteristics.

As employed above and throughout the disclosure, the following terms, unless otherwise indicated, shall be understood to have the following meanings.

The "sight picture" is the image that the shooter sees at the time they take the decision to shoot and is the image the shooter sees showing the relationship between the shooting device sighting system, the point being aimed at, and the target.

The "impact picture" is the image at the point the projectile strikes an object in the target zone.

The examples provided in the definitions present in this application are non-inclusive unless otherwise stated. They include but are not limited to the recited examples.

As used herein, the term "shooting device" includes all guns and all equipment designed to launch projectiles at a target area.

As used herein, the term "reticule" comprises: the visual representation of the point of aim and/or strike zone, and can include the characteristics of the projectile, or projectiles, including the spread of the strike zone, allowances for variations in projectile strike zone location, allowances for human reaction time and variations, and correction of variations between perceived image and actual image.

It is believed the names used herein correctly and accurately reflect the underlying components, and process equipment. However, the nature and value of the present invention does not depend upon the theoretical correctness of these, in whole or in part. Thus it is understood that the names attributed to the correspondingly indicated components, and process equipment are not intended to limit the invention in any way.

Accordingly, in one embodiment, the present invention is camera mounting hardware comprising:

(a) a set of mounting brackets that attach the camera device to a barrel in a manner that protects the barrel from damage;
(b) the mounting brackets reduce the shock and vibration the camera module is exposed to; and
(c) the mounting system allows the aim point reticule or camera aim point to be approximately aligned to, and/or calibrated to, the aim point of the shooting device; and
(d) a programming utility that allows the reticule and/or indicator generating system to add a reticule, or graticule, or indicator, to indicate aim point of the camera and/or shooting device; and
(e) a programming utility that allows the camera to have its settings programmed to match the shooting scenario and characteristics of the shooting device.

In some preferred embodiments, a laser provides alignment capabilities to align the camera aim point with the shooting device aim point.

In certain preferred embodiments, the aim point of the camera may be mechanically adjusted to reduce offset from the aim point of the shooting device.

In some preferred embodiments, the programming utility utilizes a calibration graticule to calculate corrections to the reticle position on the video frame in order align the camera, or reticle, aim point with the shooting device aim point.

In certain preferred embodiments, the camera may be mounted facing back towards the shooter. This allows the technique of the shooter during the mounting, discharging, and follow-through of the shooting device to be recorded. The camera may be mounted facing back towards the shooter in any position on the shooting device and will be determined by the desired images and the left or right handedness of the shooter.

In certain preferred embodiments, the camera may have a Field Of View (FOV) both towards the shooter and towards the target. This allows the technique of the shooter during the mounting, discharging, and follow-through of the shooting device to be simultaneously recorded with the target images. The bi-directional camera may be mounted in any position that the user determines will have suitable FOV's.

In certain embodiments the camera device will have a locating groove or equivalent that ensures the mounting brackets orientate the output images with gravity downwards in the images.

Figure 1:
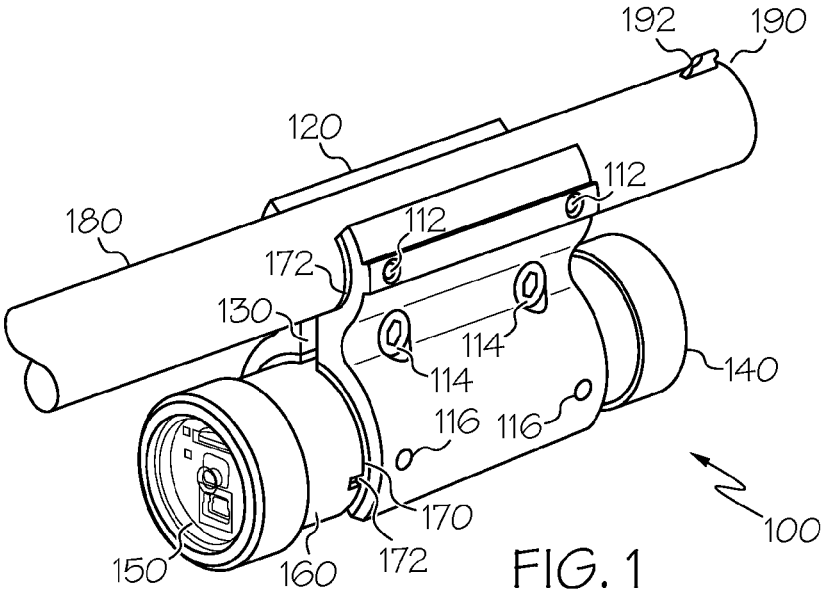
FIG. 1 is a pictorial representation of the present mounting system invention on a gun barrel and depicts some of the key elements in the shock and absorption control and damping techniques and also shows the novel translucent sealing membrane allowing ON/OFF switch activation and observation of status LED's.

FIG. 1 shows an example of the shock and vibration mitigation and control provided by the camera mounting system 100. The internal components (the electronics, optics, battery, etc.) of the camera are mounted on a carriage assembly 460. The carriage assembly 460 can move within the external camera housing 160 in such a way that the recoil from the gun 180 is reduced by the carriage assembly 460 transferring the load forces via a load ring 630 into the shock absorbing material 610 and 612 in front of the lens 690. FIG. 1 also shows the invented transparent or translucent membrane 440 that allows the status LED's to be observed and the ON/OFF switch 464 to be accessed (depressed) while additionally, and optionally, providing a water resistant seal. The carriage assembly 460 has a load baring surface (the outer diameter of the carriage assembly 460 supporting the optical sensor in the example shown) that interfaces with the load transfer device 630 (the Delrin load ring in the example shown) and both the load transfer device 630 and the carriage assembly 460 move towards the shock absorbing material 610 and 612 (O-rings in the example shown) during shooting device recoil.

Figure 4:
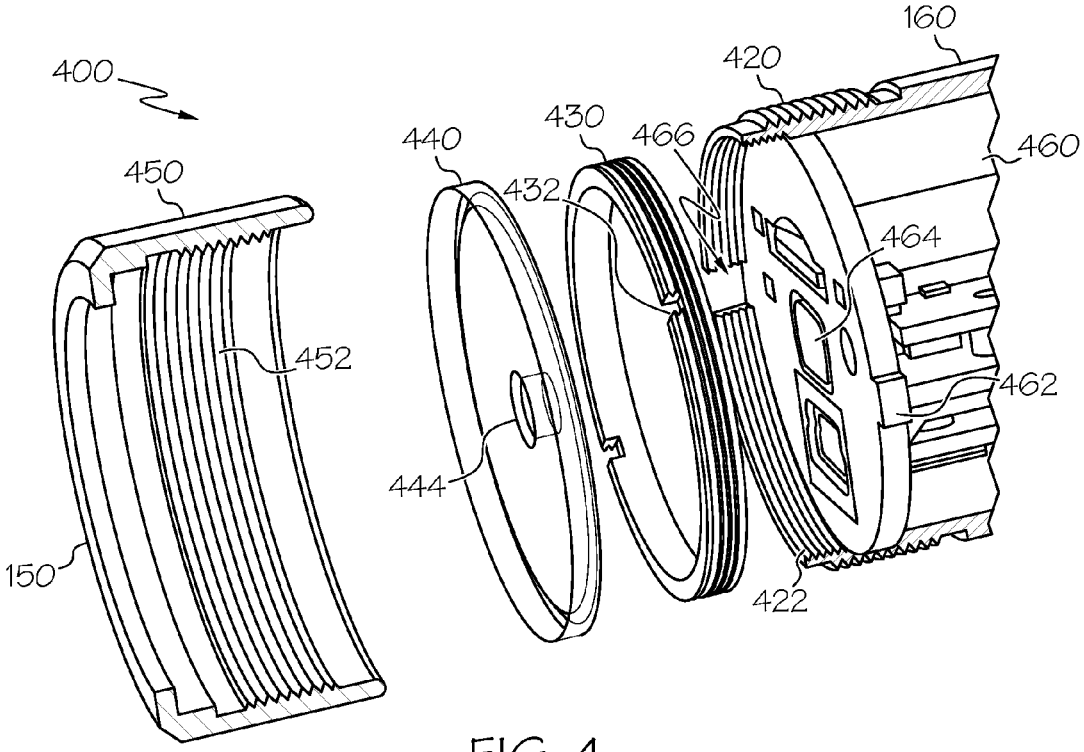
Figure 5:
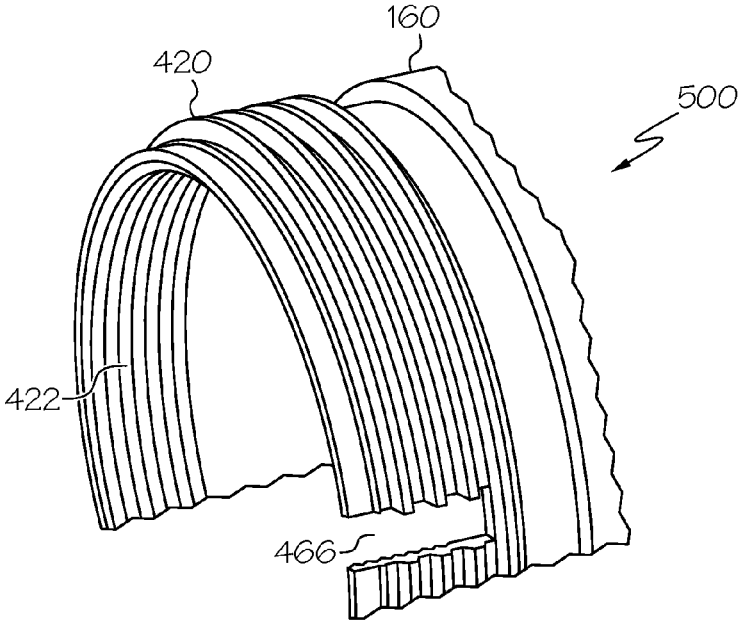

FIG. 4 shows the optional slot 466 and tab 462 scheme to orientate the carriage assembly 460 within the external housing 160 while still allowing the carriage assembly 460 to move in such a way as to reduce the impact of recoil. The carriage assembly 460 has a tab 462 and there is a corresponding slot 466 in the external housing 160 allowing a spanner ring 430, or equivalent retaining device, to apply force to prevent the carriage assembly 160 from moving toward the rear (away from the muzzle end 190 of the gun), but the slot 466 is long enough to allow the carriage assembly 460 to move forward (towards the muzzle end 190 of the gun) and compress the shock absorbing material 610 and 612 via the load ring 630. The load ring 630 can move back and forth with the recoil forces. In this example the load ring 630 is made of Delrin which has self-lubricating properties, load ring surface 632, as it is important that the load ring 630 not "bind" to the external housing 160 and prevent movement under recoil forces. The load ring 630 can vary in length to accommodate different lens 690 geometries.

FIG. 2 through FIG. 9 shows the optional matching of the load transferring device surface 802 to the shock absorbing material surface 610 to better transfer the loads. The load ring 630 in this example is made of Delrin and has a contour on the face 802 that is placed against the O-ring 610. In the optional case the camera is facing back towards the shooter the above scheme is reversed so that the back of the carriage assembly 460 (opposite end to the lens) will move towards the shock absorbing material 610 and 612.

Figure 2:
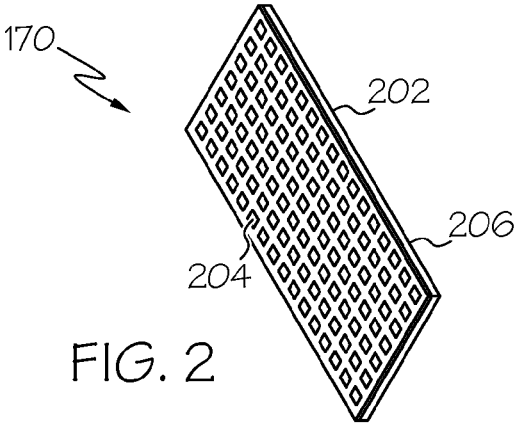
FIG. 2 through FIG. 3 is a pictorial representation of shock absorbing material.
Figure 3:
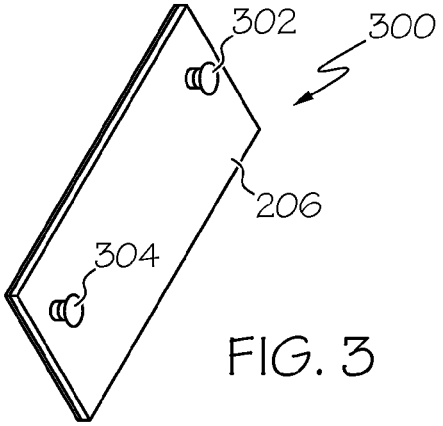

FIG. 1 through FIG. 3 shows the shock and vibration from the gun barrel 180 must pass through the shock absorbing material 206 (black rubber in this example) that is between the barrel 180 and the mounting brackets 110 and 120. In addition, and optionally, the shock and vibration from the gun barrel 180 must pass through a second layer of shock absorbing material 206 (black rubber in this example) that is between the mounting brackets 110 and 120 and the camera housing 160. In the example shown the shock absorbing material 206 has a pattern 204 on the barrel 180 side to both improve shock and vibration performance and to prevent the camera 160 from moving on the barrel 180, e.g. sliding toward the muzzle 190 during recoil. Additionally, and optionally, the shock absorbing pads 206 in this example have nipples 302 and 304 (protrusions) that locate and retain the pads in the mounting brackets 110 and 120.

FIG. 1 through FIG. 9 shows the example of a shotgun mount and the same principles for a single barrel shotgun can be applied to most bolt-action rifles and revolvers. Shotguns have the added complexity that many have double barrels in either an over-and-under (O/U) or side-by-side (S×S) configuration. There are multiple mounting variations with size of barrel and barrel configuration but the basic principles shown in FIG. 1 are:

1. Mounting brackets 110 and 120 that clamp the camera 100 to the barrel 180 with the clamps 110 and 120 being configured to prevent interruption of the gun sight picture 192 seen by the shooter,
2. A clamping system 110 and 120, where the clamps can be one on each side, or two on each side,
3. Shock absorbing material between the clamps 110 and 120 and the barrel 180, and optionally between the camera assembly 160 and the clamps 110 and 120,
4. Optional nipples 302 and 304 on the shock absorbing material 170 to locate and retain the shock absorbing material 170 to the clamps 110 and 120,
5. Optional geometries of shock absorbing material 170 (ridge 172 in the example shown) that match optional geometries in the camera housing 160 (groove 162 in the example shown) that cause the camera 160 to be orientated so that the playback video has the correct orientation by offsetting from 180 degrees to ensure that the camera assembly 160 can only be mounted in one vertical orientation in the mounting brackets 110 and 120.

Where possible, the clamping hardware mounting system 100 will have the option of facing the camera 160 back towards the shooter to provide the option of recording video of the shooter and shooting device.

The barrel size of both handguns and long guns varies considerably. The mounting hardware design 100 allows the accommodation of various barrel sizes such as 12 and 20 gauge in shotguns; single barrel, double barrel over & under, and double barrel side by side shotguns; 22, 38 and 45 calibers in handguns; 223, 243, 270, 300, and 338 in rifles, etc., etc.

The mounting hardware design 100 allows the accommodation of various bow and crossbow mounting systems. For example a bow stabilizer can take the place of the gun barrel 180 and allow the mounting system 100 to be used on a bow. Similarly the scope on a crossbow can take the place of the gun barrel 180 and allow the mounting system 100 to be used on a crossbow.

Figure 10:
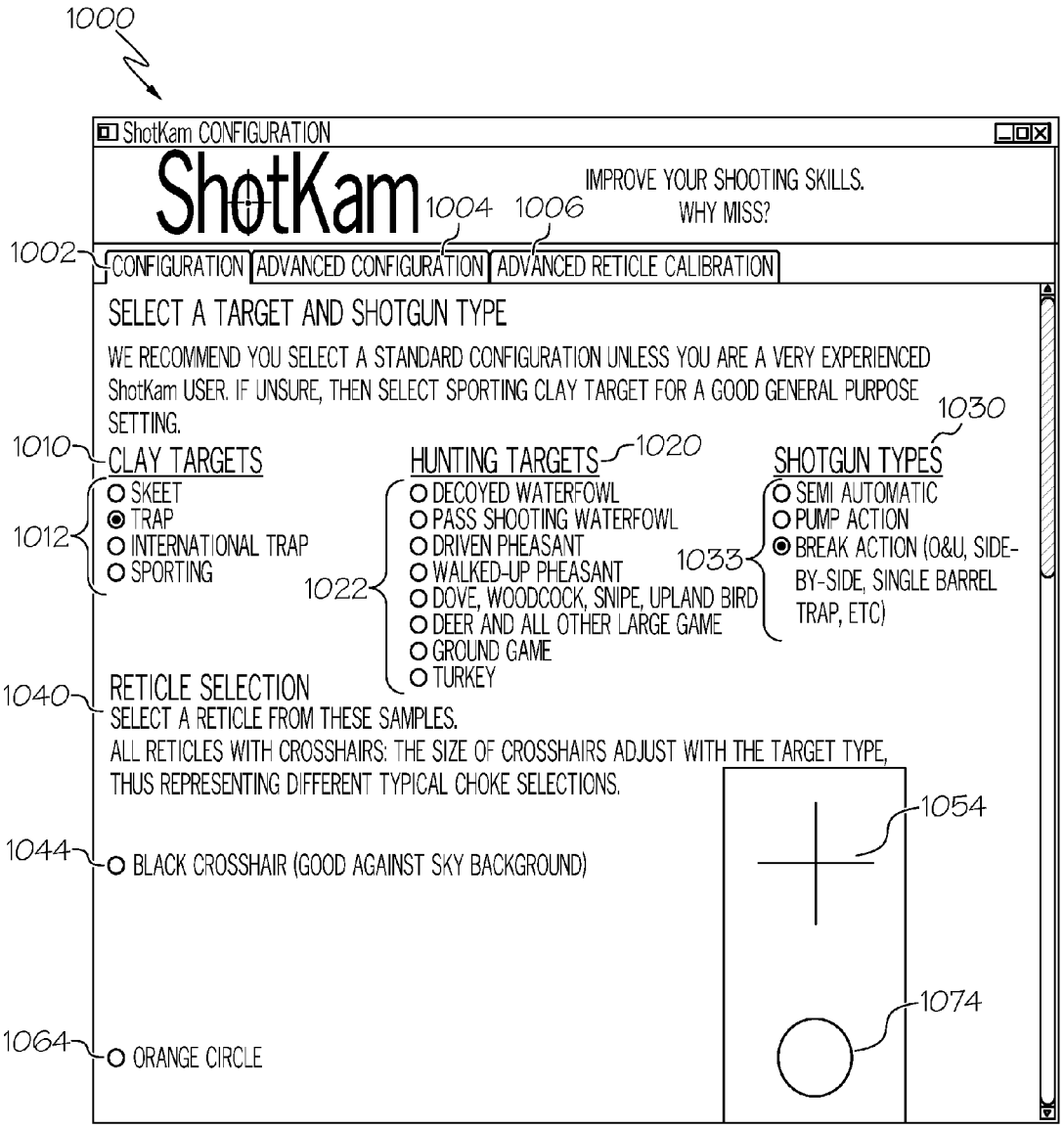
FIG. 10 shows the graphical user interface allowing the end user to select the options to match the shooting scenario.

FIG. 10 shows the programming utility end user interface 1000 and shows a selection of pre-programmed 1002, or default choices available to match the camera performance to the performance of the shooting device and projectiles. The programming utility interface 1000 allows users to select the camera configuration for their target 1010 and 1020, gun type 1030, and reticle style 1040. The values and camera settings associated with their choices 1012, 1022, 1033, 1044, and 1064 are pre-programmed default values that have been determined to be suitable in their choice of shooting application. The size of the reticle 1054 adjusts with the target type 110 and 1020 thus representing different typical choke 1112 selections. The more choke constriction 1122 the smaller the reticle 1054.

Figure 11:
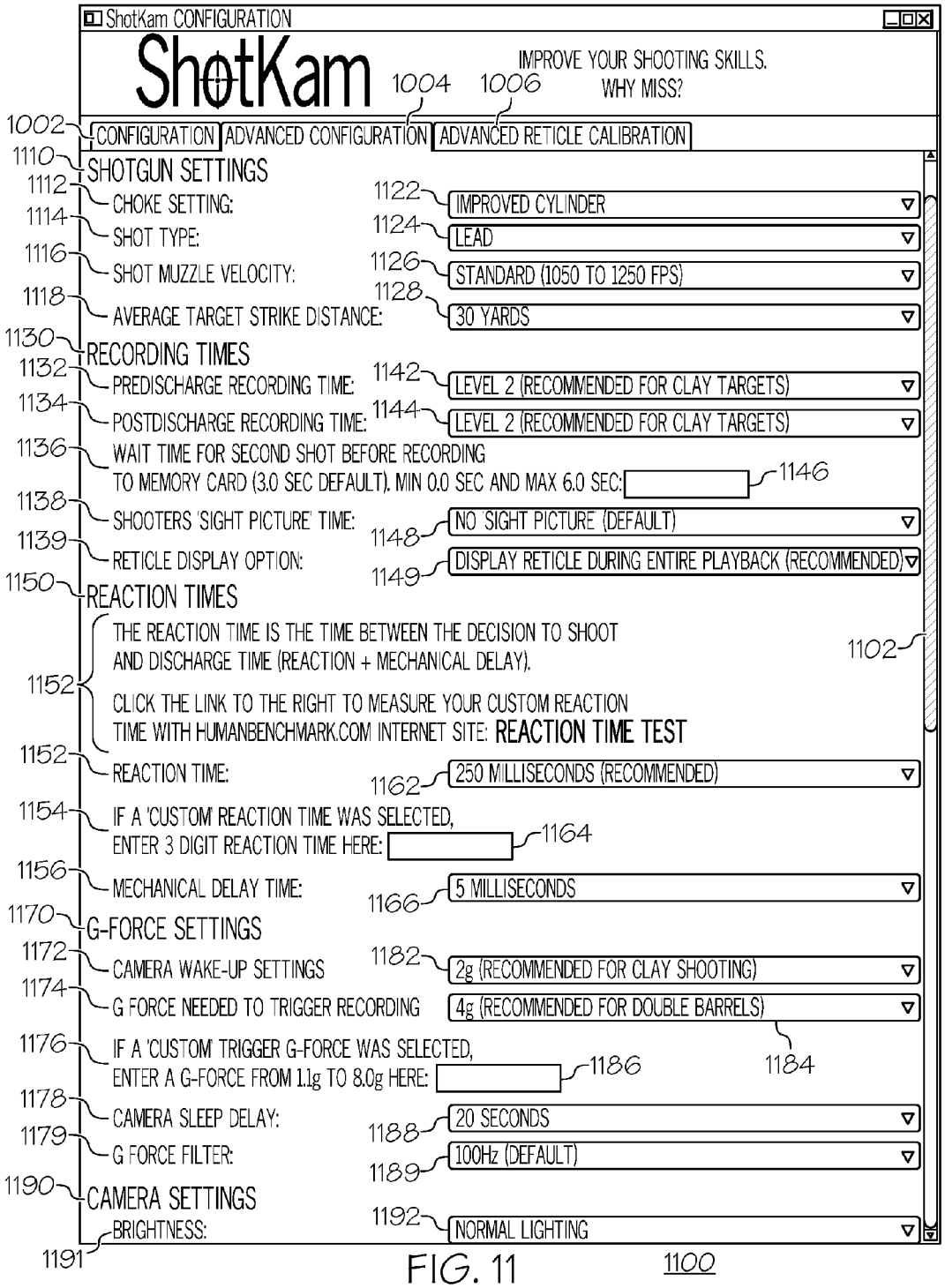
FIG. 11 shows the graphical user interface allowing the end user to select the advanced options to match the shooting scenario.

FIG. 11 shows the programming utility end user interface 1000 for Advanced Configuration 1004 and shows a selection of the custom, or user programmable choices available to match the camera performance to the performance of the shooting device and projectiles. User programmable choices are available for Shotgun Settings 1110, Recording Times 1130, Reaction Times 1150, G-Force settings 1170, and Camera Settings 1190. The choices for each section are shown below.

Shotgun Settings 1110:
- Choke Setting 1112 with a selection from standard choke constrictions such as Improved Cylinder 1122
- Shot Type 1114 with a selection from shot types such as Lead 1124.
- Shot Muzzle Velocity 1116 with a selection from standard muzzle velocities such as 1050 to 1250 feet per second 1126.
- Average Target Strike Distance 1118 with a selection from standard distances such as 30 yards 1128.

Recording Times 1130:
- Predischarge Recording Time 1132 with a selection from recommended times such as Level 2 1142.
- Postdischarge Recording Time 1134 with a selection from recommended times such as Level 2 1144.
- Wait Time For second Shot Before recording To Memory Card 1136 with a selection from recommended 0 seconds to 6 seconds 1146.
- Shooter's Sight Picture Time 1138 with a selection from recommended No "Sight Picture" 1148 to 3 seconds.
- Reticle Display Option 1139 with a selection from Display reticle During Entire Playback 1149 to only during "Sight Picture"

Reaction Times 1150:
- Reaction Time 1152 with a selection from recommended times such as 250 Milliseconds 1162 to a Custom Reaction Time 1164
- Mechanical Delay Time 1156 with a selection from recommended times such as 5 Milliseconds 1166 to 10 Milliseconds.

G-Force Settings 1170:
- Camera Wake-Up settings 1172 with a selection from recommended G-Forces such as 2G 1182.
- G-Force Needed To Trigger Recording 1174 with a selection from recommended G-Forces such as 4G 1184.
- Custom G-Force Needed To Trigger Recording 1176 with a selection from 1.1G to 8G 1186.

Camera Sleep Delay 1178 with a selection of times before camera goes to sleep from recommended times such as 20 seconds 1188 to 600 seconds.

G Force Filter setting 1179 with a selection of frequencies such as 100 Hz 1189 in the range from OFF to 2000 Hz.

Camera Settings 1190:

Brightness 1191 with a selection from recommended light conditions such as Normal Lighting 1192 in the range from low to bright lighting.

Figure 12:
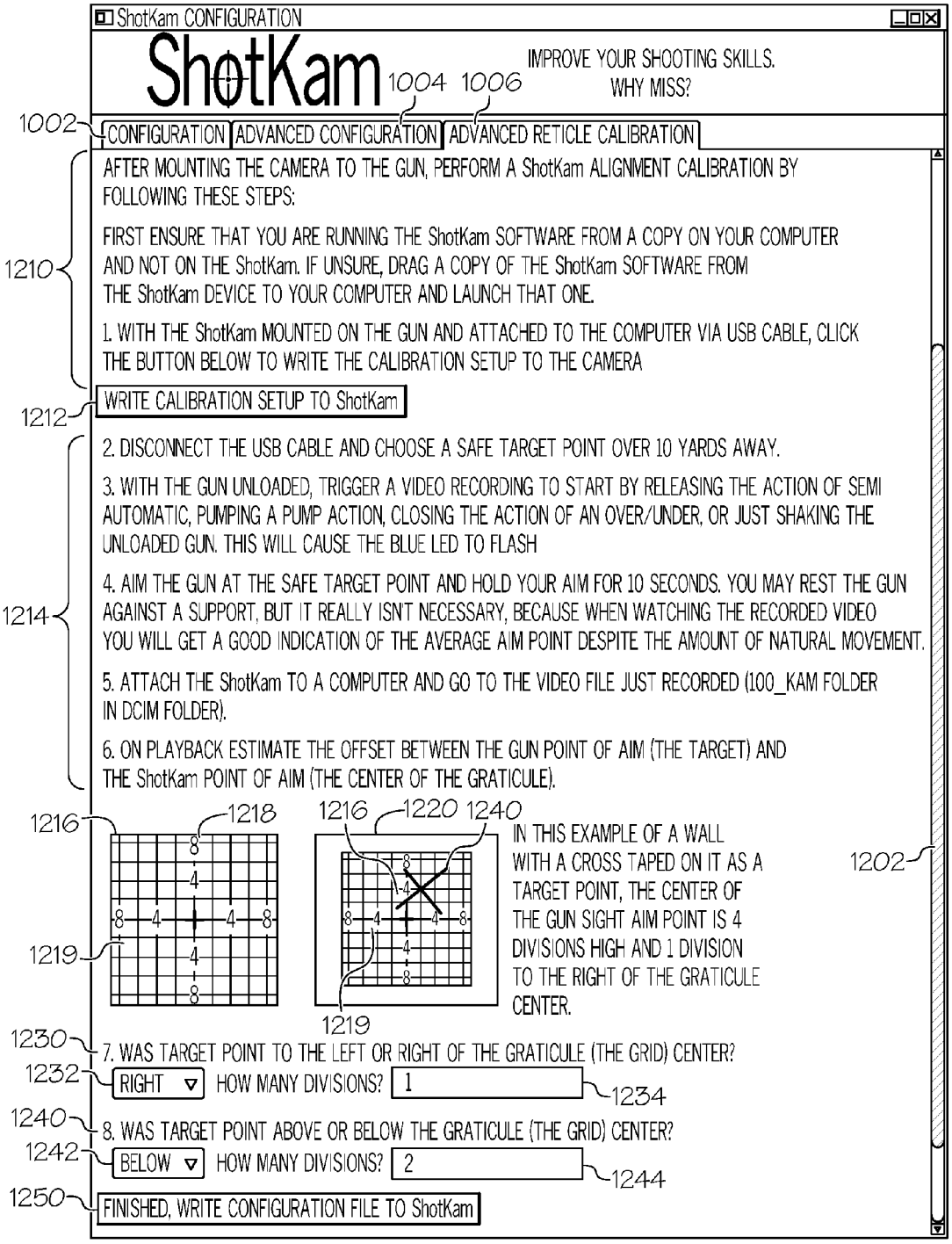
FIG. 12 shows the graphical user interface allowing the end user to align the camera point of aim with the shooting device point of aim.

FIG. 12 shows the programming utility end user interface for Advanced Reticle Calibration 1006 and shows a process for calibrating the camera point of aim and optional reticule to the shooting device point of aim to bring them in to closer alignment. With the ShotKam camera 100 mounted on the gun FIG. 1 the user is instructed to write the calibration setup to the Camera 1210. Calibration setup is written to ShotKam camera by selecting button 1212. The user then triggers a video to be taken of the gun pointed at target 1214. The trigger to take a video is the G-force level 1174 sensed from closing the guns action or just a shake of the gun. By selecting the "Write Calibration Setup To ShotKam" the calibration graticule 1216 is used as the overlay in the calibration video. The center of the graticule 1216 represents the ShotKam Point Of Aim before calibration. The target 1240 in the video represents the gun point of aim. The user then estimates the calibration offset amounts from the graticule center 1216 (ShotKam point of aim) and the target 1240 (gun point of aim). The horizontal offset is measured in divisions 1219 and entered by the user 1234. The vertical offset is measured in divisions 1218 and entered by the user 1244.

In the video format used in a further example the center of the video frame is 640 pixels from the left and 360 pixels from the top. The graticle 1216 is written so that the center of the graticle 1216 is at the center of the video frame. Therefore if the target aim point 1240, as perceived by the shooter, was 30 pixels to the right and 28 pixel lower, then the aim point reticle 1054 would be moved on the video frame 30 pixels to the right and 28 pixels lower, resulting in the reticle 1054 center being at 670 pixels from the left and 388 pixels from the top. Therefore after calibration the reticle 1054 is closely aligned to the target 1240.

Figure 13:
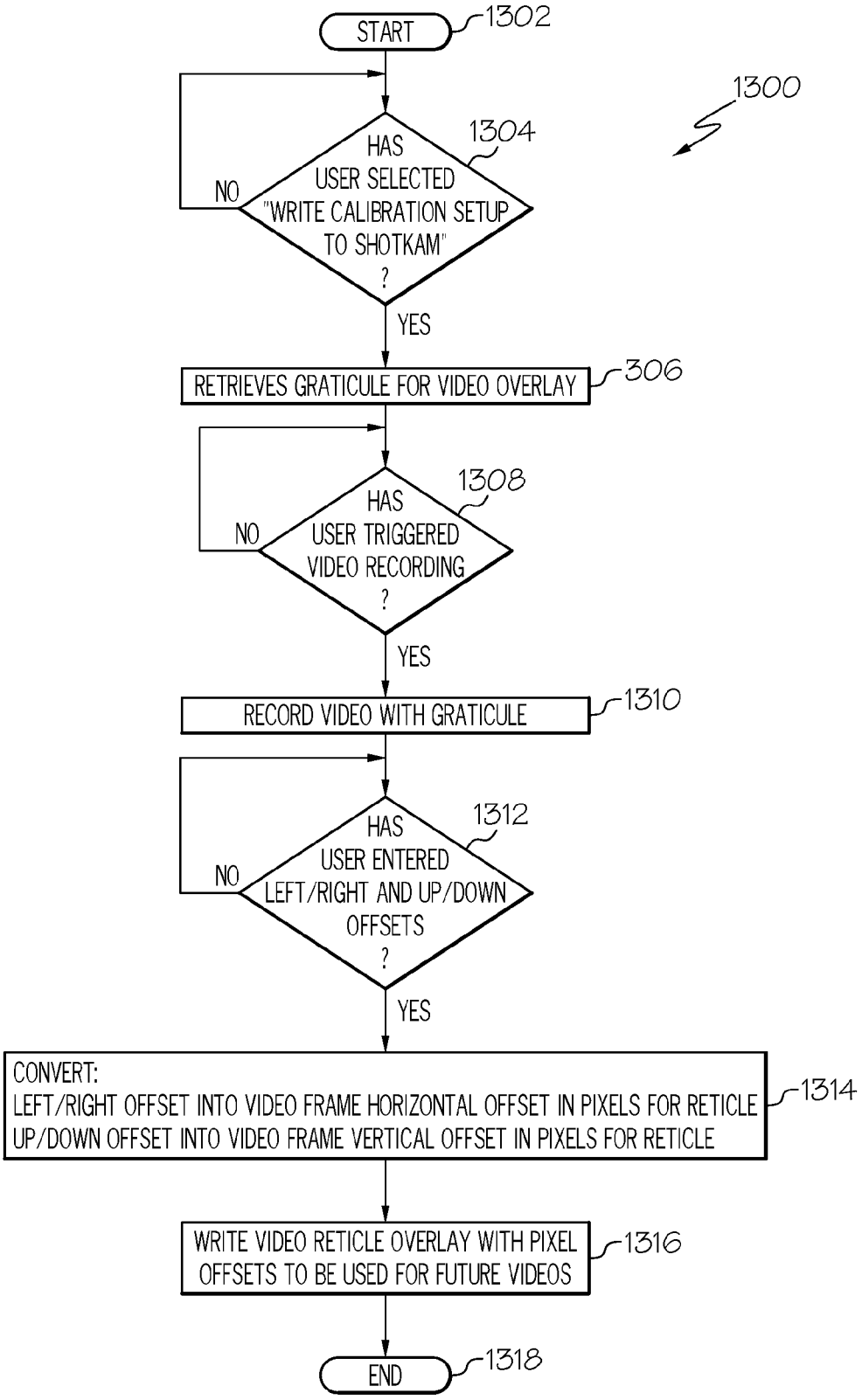
FIG. 13 is a flow chart of the based on text in FIGS. 10-13 and Embodiments 9-13 described below for the reticule calibration mode.

FIG. 13 is a flow chart representation of the process described above and in FIG. 12. The original factory offsets are zero and zero. The user starts 1302 the Advanced Reticle Calibration by entering the user interface 1006. The camera waits until the user activates "Write Calibration Setup To ShotKam" 1304. The graticule 1216 is retrieved from non-volatile memory and used as the overlay. The camera waits until the user triggers a video recording by exceeding the G-Force trigger level 1308. The camera records the video 1310 of the user aiming at a target 1240 with the graticle 1216 overlay. The camera waits until the user enters horizontal and vertical offsets 1312. The camera converts the user entered horizontal and vertical offsets to a pixel distance 1314. The correction pixel distances are used to move the center of reticle 1054 for use in subsequent videos taken after the Advanced Reticle Calibration has been completed 1318.

When ranges are used herein for physical properties, such as time or distance, all combinations and sub combinations of ranges and specific embodiments therein are intended to be included.

The disclosures of each patent, patent application and publication cited or described in this document are hereby incorporated herein by reference, in their entirety.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

Embodiment 1

A set of hardware to mount a camera device comprising:

(a) A pair of clamps, or optionally two sets of clamps, that hold the camera in place on a shooting device; and (b) the mounting hardware protects the surface of the shooting device; and (c) the mounting hardware absorbs and mitigates the shock and vibration from the shooting device discharge; and (d) the mounting hardware aligns the camera system so that the aim point reticule or camera aim point is approximately aligned to, and/or calibrated to, the aim point of the shooting device.

Embodiment 2

The camera mounting hardware according to Embodiment 1, wherein the camera device is mounted on a shooting device and utilizes some or all of the shock and vibration mitigation and control systems as described in FIGS. 1-9.

Embodiment 3

The camera mounting hardware according to Embodiment 1, wherein the camera device is mounted on a shooting device and utilizes the translucent membrane as described in FIG. 1 and FIG. 4.

Embodiment 4

The camera mounting hardware according to Embodiment 1, wherein the camera device is mounted on a shooting device and utilizes the load transfer device as described in FIGS. 1 and FIGS. 6-9.

Embodiment 5

Figure 6:
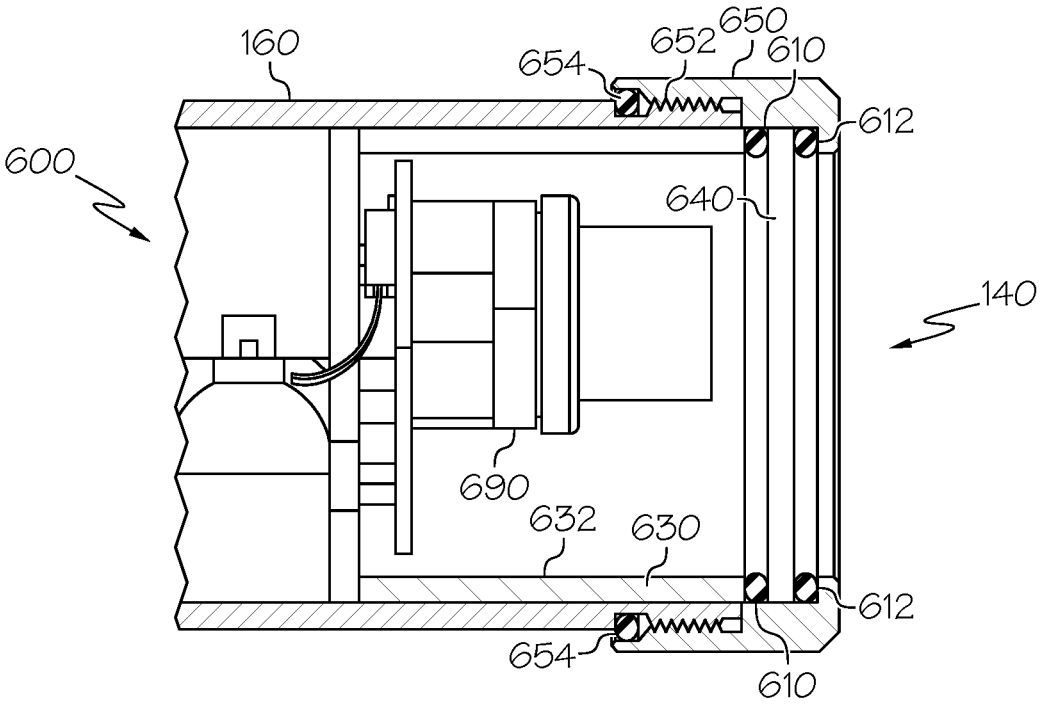
Figure 7:
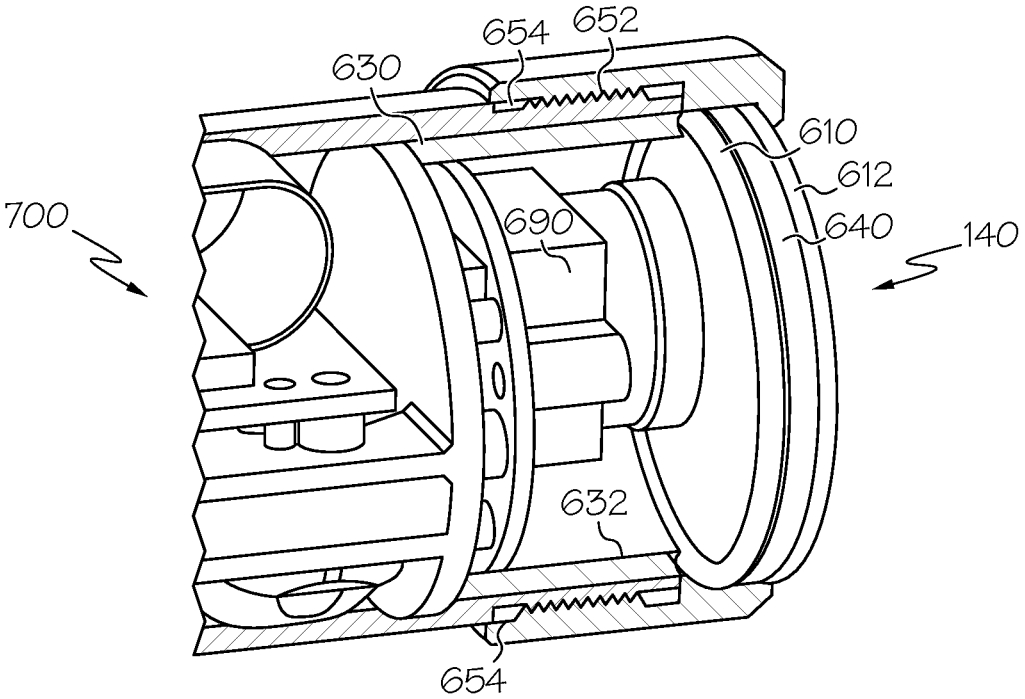

The camera mounting hardware according to Embodiment 1, wherein the camera device is mounted on a shooting device and utilizes the shock absorbing material (O-rings in the example) as described in FIGS. 1 and FIGS. 6-7.

Embodiment 6

The camera mounting hardware according to Embodiment 1, wherein the camera device is mounted on a shooting device and utilizes the shock absorbing material (pads in the example) as described in FIGS. 1-3.

Embodiment 7

The camera mounting hardware according to Embodiment 1, wherein the camera device point of aim can be aligned with the shooting device point of aim using a laser which is either integrated into the camera device or an attachable accessory. The laser point of aim is aligned with the camera point of aim which in turn allows the alignment of the shooting device point of aim.

Embodiment 8

The camera mounting hardware according to Embodiment 1, wherein the camera device has the optional feature of pointing rearwards towards the shooter.

FIG. 13 is a flow chart of the based on text in FIGS. 10-13 and Embodiments 9-13 described below for the reticule calibration mode.

Embodiment 9

A programming utility that allows the reticule and/or indicator generating system to add a reticule, or graticule, or indicator, to indicate aim point of the camera and/or shooting device; and that has an end user interface allowing selection of the camera settings available to match the camera performance to the performance of the shooting device and projectiles. The programming utility allows the camera to have its settings programmed to match the shooting scenario and characteristics of the shooting device.

Embodiment 10

A programming utility that allows the camera device point of aim compensation and correction system, wherein the camera device has optional laser or optical alignment capabilities that allow for the offset of the camera point of aim and the shooting device point of aim to be reduced and compensated for (brought into alignment) for image display by programming a correction into the camera unit or the display unit. The user generated offset data is processed by the camera unit, or the display unit, to allow the display images to have the point of aim of both the camera unit and the shooting device brought into reasonably close alignment.

Embodiment 11

A programming utility that allows the programming of a camera device according to Embodiment 9, wherein the camera device can display multiple reticules, or graticule, corresponding to the point of aim and strike point or path of projectile.

Embodiment 12

A programming utility that allows the programming of a camera device according to Embodiment 9, wherein the camera device can go in to sleep mode at user programmed times and be woken up at user programmed motion levels.

Embodiment 13

A programming utility that allows the programming of a camera device according to Embodiment 10, wherein the camera device can write a graticule onto a video frame that allows the user to determine the correction in pixels which will bring the camera point of aim reticle to be aligned to the shooting device point of aim as determined by the user.

1. A set of hardware to mount a camera device comprising:

(a) A pair of clamps, or optionally two sets of clamps, that hold the camera in place on a shooting device; and (b) the mounting hardware protects the surface of the shooting device; and (c) the mounting hardware absorbs and mitigates the shock and vibration from the shooting device discharge; and (d) the mounting hardware aligns the camera system so that the aim point reticule or camera aim point is approximately aligned to, or calibrated to, the aim point of the shooting device.

2. The camera mounting hardware according to claim 1, wherein the camera device is mounted on a shooting device and utilizes a slot allowing the internal components mounted on a carriage assembly to move during recoil in order to reduce the shock and vibration effects of recoil on those components.

3. The camera mounting hardware according to claim 1, wherein the camera device is mounted on a shooting device and utilizes a load transferring device allowing the internal components mounted on a carriage assembly to move during recoil and transfer the loads to a shock absorbing material.

4. The camera mounting hardware according to claim 1, wherein the camera device is mounted on a shooting device and utilizes one or more O-rings as the shock absorbing material, or other suitable shock absorbing material, at the lens end of the camera to absorb shock and vibration from the carriage assembly containing the components most sensitive to shock and vibration.

5. The camera mounting hardware according to claim 1, wherein the camera device is mounted on a shooting device and utilizes a translucent membrane to allow visual inspection of status LED's.

6. The camera mounting hardware according to claim 1, wherein the camera device is mounted on a shooting device and utilizes a translucent membrane to allow an ON/OFF switch to be activated by depressing the membrane.

7. The camera mounting hardware according to claim 1, wherein the camera device is mounted on a shooting device and utilizes a pad of shock absorbing material between the barrel and the mounting system to absorb the shock and vibration.

8. The camera mounting hardware according to claim 1, wherein the camera device is mounted on a shooting device and utilizes a pad of shock absorbing material between the mounting system brackets and the housing containing the camera to absorb the shock and vibration.

9. The camera mounting hardware according to claim 1, wherein the camera device is mounted on a shooting device and utilizes pads of shock absorbing material between both the barrel and the mounting system bracket, and between the mounting system bracket and the housing containing the camera to absorb the shock and vibration. This configuration means that the shock and vibration must pass between at least two pads to reach the housing containing the camera.

10. The camera mounting hardware according to claim 1, wherein the camera device point of aim can be aligned with the shooting device point of aim using a laser which is either integrated into the camera device or an attachable accessory. The laser point of aim is aligned with the camera point of aim which in turn allows the alignment of the shooting device point of aim.

11. The camera mounting hardware according to claim 1, wherein the pads between the mounting brackets and the camera housing have optional geometries of shock absorbing material (ridges in the example) that match optional geometries in the camera housing (grooves in the example) that cause the camera to be orientated so that the playback video has the correct orientation.

12. The camera mounting hardware according to claim 1, wherein the camera is facing back towards the shooter and the muzzle end of the carriage assembly (opposite end to the lens) will move towards the shock absorbing material at the muzzle end.

13. A programming utility that allows the reticule or indicator generating system to add a reticule, or graticule, or indicator, to indicate aim point of the camera or shooting device; and that has an end user interface allowing selection of the camera settings available to match the camera performance to the performance of the shooting device and projectiles. The programming utility allows the camera to have its settings programmed to match the shooting scenario and characteristics of the shooting device.

14. The programming utility according to claim 13, wherein the programming utility enables an optional laser or optical alignment capability to correct for any misalignment in the point of aim reticule, or indicator, and the shooting device point of aim. The measured offset data, the correction amount, is processed by the camera unit, or the display unit, to allow the point of aim reticule or indicator to be brought into reasonably close alignment with the shooting device point of aim.

15. The programming utility according to claim 13, wherein the programming utility programs the camera device reticule or indicator generating system to add a reticule, or graticule, or indicator, to indicate aim point of the camera or shooting device where the reticule or indicator generating system is independent and separate from the sighting system or targeting scope of the shooting device.

16. The programming utility according to claim 13, wherein the programming utility enables the programming of a camera device to be bi-directional and having two separate image sensors, allowing the recording or display of the field of view towards the target and the field of view towards the shooter.

17. The programming utility according to claim 13, wherein the programming utility enables the programming of a camera device to allow for the reticule style, size, and shape, to represent the characteristics of the projectile or projectiles. These characteristics include, but are not limited to, the spread of multiple projectiles, the drop of a projectile, the strike zone of projectiles, and the flight path errors of projectiles.

18. The programming utility according to claim 13, wherein the programming utility enables the programming of a camera device to allow for the point of aim reticule or indicator to be referenced to the shooting device prior to the shooters decision to shoot and referenced to the image data at some point after the shooters decision to shoot. The image processing capability allows the reticule or indicator to transition to being fixed in space relative to the background image or image reference point. This allows the display of one or two reticules or indicators. The first continues to indicate the position of the point of aim of the shooting device; the second indicates the point in space where the projectile is anticipated to travel towards. In the case of a skeet shooter, the point of aim reticule or indicator can be displayed on the images and then at, or after, the point in time the shooter decides to shoot a second reticule or indicator is added to the image but is no longer representing the point of aim of the shooting device, instead this second reticule or indicator represents the point in space that the projectile is traveling towards.

19. The programming utility according to claim 13, wherein the programming utility enables the camera device to write a graticule onto a video frame that allows the user to determine the correction in pixels, or equivalent video frame units, which will bring the camera point of aim reticle into alignment with the shooting device point of aim as perceived by the shooter.

20. The programming utility according to claim 13, wherein the programming utility enables the programming of a camera device to go in to sleep mode at user programmed times and be woken up at user programmed motion levels as measured by an accelerometer.

What is claimed:

1. A shock absorbing camera mount for a gun comprising:

a mounting bracket with an upper portion having an opening defined therein for firmly mechanically attaching to at least one barrel of a gun and a lower portion for firm mechanically attaching to a tube assembly; and the tube assembly adapted to slidably mount carriage assembly of a camera therein, the tube assembly including:

a first end with a first captive cap holding a lens window directed toward a gun front sight when mounted on the gun, the first end including a load transfer ring positioned between the first captive cap and a carriage assembly of the camera;

a second end with a second captive cap, the second end having a threaded inner surface; and a lock ring for rotatably engaging the threaded inner surface of the second end so as to provide a coaxial force to urge the carriage assembly of the camera towards load transfer ring.

2. The shock absorbing camera mount of claim 1, wherein the second end includes at least one slot formed therethrough and the carriage assembly of the camera includes at least one tab adapted to slide in the slot.

3. The shock absorbing camera mount of claim 1, wherein the mounting bracket includes a right-hand side and a left-hand side, that when joined together form substantially figure eight shape with an opening formed both at a top end and at a bottom end of the figure eight shape.

4. The shock absorbing camera mount of claim 3, wherein the right-hand side and the left-hand side are mechanically joined together using one or more rotatable fasteners.

5. The shock absorbing camera mount of claim 4, further comprising:

a set of upper rubber pads disposed within the opening of the upper portion of the mounting bracket and the barrel of the gun;

a set of lower rubber pads disposed between the lower portion of the mounting bracket and the tube assembly; and wherein the mounting bracket includes a right-hand side and a left-hand side, that when joined together form substantially figure eight shape with an opening formed both at a top end and at a bottom end of the figure eight shape, and when the top end of the mounting bracket is clamped to the barrel of the gun and the bottom end of the mounting bracket is clamped to the tube assembly, a gap between the right-hand side and a left-hand side is formed thereby directing any vibrations between the barrel of the gun and the tube assembly through both the upper and the lower rubber pads and when the rotatable fasteners joining the right-hand side and the left-hand side of the camera mount are in the gap and do not allow any vibrations to bypass the upper rubber pads and the lower rubber pads.

6. The shock absorbing camera mount of claim 1, wherein an outside portion of the first end of the assembly tube is threaded and an inside surface of the first captive cap is threaded to be rotatably coupled with the first end.

7. The shock absorbing camera mount of claim 1, further comprising:

a lens window held by the first captive cap; and at least a first O-ring disposed between the lens and the first captive cap.

8. A shock absorbing camera mount for a gun comprising:

a mounting bracket with an upper portion having an opening defined therein for firmly mechanically attaching to at least one barrel of a gun and a lower portion for firm mechanically attaching to a camera assembly;

a set of upper rubber pads disposed within the opening of the upper portion of the mount bracket and the barrel of the gun;

a set of lower rubber pads disposed between the lower portion of the mount bracket and the camera assembly; and wherein the mounting bracket includes a right-hand side and a left-hand side, that when joined together form substantially figure eight shape with an opening formed both at a top end and at a bottom end of the figure eight shape, at least one rotatable fastener positioned between the top end and the bottom end of the figure eight shape to clamp the right-hand side to the left-hand side, and wherein the top end of the mounting bracket is clamped to the barrel of the gun and the bottom end of the mounting bracket is clamped to the camera assembly, a gap between the right-hand side and a left-hand side is formed thereby directing any vibrations between the barrel of the gun and the camera assembly through both the set of upper rubber pads and the set of lower rubber pads and the rotatable fastener therebetween and wherein the rotatable fastener joining the right-hand side and the left-hand side of the camera mount are in the gap and do not allow any vibrations to bypass the set of upper rubber pads and the set of lower rubber pads.

9. The shock absorbing camera mount of claim 8, wherein a second end includes at least one slot formed therethrough and a carriage assembly of the camera assembly includes at least one tab adapted to slide in the slot.

10. The shock absorbing camera mount of claim 8, wherein the right-hand side and the left-hand side are mechanically joined together using one or more rotatable fasteners.

* * * * *